US011247082B2

(12) United States Patent
Tignor

(10) Patent No.: US 11,247,082 B2
(45) Date of Patent: Feb. 15, 2022

(54) SYSTEM, METHOD, AND APPARATUS FOR THE SUPPRESSION OF FIRE GROWTH

(71) Applicant: ArchAngel Fire Systems Holdings, LLC, Fort Worth, TX (US)

(72) Inventor: Archie Wayne Tignor, Fort Worth, TX (US)

(73) Assignee: ArchAngel Fire Systems Holdings, LLC, Fort Worth, TX (US)

( * ) Notice: Subject to any disclaimer, the term of this patent is extended or adjusted under 35 U.S.C. 154(b) by 634 days.

(21) Appl. No.: 15/971,385

(22) Filed: May 4, 2018

(65) Prior Publication Data

US 2019/0336800 A1 Nov. 7, 2019

(51) Int. Cl.
*A62C 2/04* (2006.01)
*A62C 99/00* (2010.01)

(52) U.S. Cl.
CPC ..... *A62C 2/04* (2013.01); *A62C 99/0063* (2013.01)

(58) Field of Classification Search
CPC ..... A62C 2/04; A62C 99/0063; A62C 35/605; A62C 2/247; A62C 35/00; A62C 35/68; A62C 3/002; A62C 3/14; A62C 99/0018; A62C 2/12; A62C 2/24; A62C 99/0009; F24F 11/0001; F24F 11/34; F24F 11/35
USPC ..... 169/46
See application file for complete search history.

(56) References Cited

U.S. PATENT DOCUMENTS 3,866,687 A * 2/1975 Banner ..... A62C 35/605 169/61
5,825,294 A * 10/1998 Krueger ..... G01K 3/00 340/594
5,855,510 A * 1/1999 McKenzie ..... A62C 2/24 454/342
2001/0035462 A1* 11/2001 Collazo ..... A62C 2/04 236/49.2
2009/0038811 A1* 2/2009 Wagner ..... A62C 99/0018 169/46
2016/0084513 A1* 3/2016 Lee ..... A62C 35/68 454/239
2016/0278233 A1* 9/2016 Botter ..... A62C 5/006

* cited by examiner

*Primary Examiner* — Darren W Gorman
*Assistant Examiner* — Juan C Barrera
(74) *Attorney, Agent, or Firm* — Fogarty LLP

(57) ABSTRACT

An improved system and method for detection and suppression of fire that addresses the elements of the fire tetrahedron (e.g., heat, oxygen, fuel-rich smoke) to detect and suppress fires is described. Embodiments are comprised of a processor in communication with a detector, a fan, and a number of dampers. Upon detection of a triggering condition by the detector, the processor causes signals to be transmitted to the fan and dampers. Resulting changes to dampers and fans redirects airflow to evacuate heat, oxygen, and fuel-rich smoke through one or more vents in the compartment in which the triggering condition was detected. Advantages of described embodiments include utilizing existing HVAC systems, removing elements of the fire tetrahedron to suppress fires, and reducing unnecessary damage that may be caused by prior art suppression systems (e.g., sprinklers).

9 Claims, 6 Drawing Sheets

SYSTEM, METHOD, AND APPARATUS FOR THE SUPPRESSION OF FIRE GROWTH

BACKGROUND OF THE INVENTION

Fire has long been a destructive force that can be hazardous to humans. The evolution of legacy home construction and materials in modern homes presents an increased danger to human life. In the United States alone, between 2005-2009, on an annual basis, roughly 373,900 residential fires have caused over 2,600 deaths and nearly 13,000 injuries. Modern residences are filled with synthetic and petroleum-based materials that undergo pyrolysis and gasification effects of fire at an accelerated rate compared to legacy materials. When subjected to fire and heat these synthetic materials produce toxic and highly combustible fuel-rich smoke. This fuel rich smoke exacerbates the heat release rate, growth, spread, noxious nature, and mortal danger of fire.

The nature of fire's danger is that in the modern home, an entire room can be engulfed in flame and combust due to an event called flashover. A burning cigarette, for example, dropped onto a couch, may cause flames and ultimately result in a flashover event within 180 seconds of being dropped. Even before flashover occurs, within 60 seconds, a room may be sufficiently filled with smoke, heat, and toxic gases such that a human, previously laying in bed, may rise, inhale, and immediately become asphyxiated by the "smoke layer" consisting of heat, fuel rich smoke, gas, and particulate.

Fire is an exothermic chemical reaction between a fuel and an oxidizer resulting in combustion. The initiation and continuance of combustion require four components as depicted in the fire tetrahedron. The mechanics of fire, and consequently its suppression, can be better understood through the tetrahedron. The tetrahedron, a common model used to describe the inputs necessary for fire, is comprised of four elements: heat, fuel, chemical chain reactions, and an oxidizing agent (commonly oxygen). Removal or reduction of any of the facets of the fire tetrahedron can extinguish a fire completely or, at a minimum, slow its growth.

To protect human life from the dangers of fire, smoke detection devices are frequently used. Among others, these devices may include photoelectric sensors that detect particulate matter and ionization detectors which detect the presence of elements in sampled air that bind to an ion contained within a chamber. One shortcoming of such detection systems, however, is that they may detect fires and alert human occupants in a dwelling at a time that is too late for the occupant to safely evacuate. For example, if a fire has been present long enough to create sufficient smoke to activate an alarm, that smoke layer, containing fuel rich smoke, toxic gas, mortal heat, and particulate may be as little or even less than four feet from the floor. With a single inhalation this smoke may cause instant death, disorientation, unconsciousness, or inability to navigate to an exit from the dwelling. The presence of modern synthetic and petroleum based materials within a dwelling (now prevalent) exacerbates this problem by releasing fuel rich smoke that quickly consumes breathable oxygen.

Furthermore, although fire detection systems are valuable, detection alone does nothing to combat the growth of a fire. While some fire suppression systems exist, such as fire sprinkler systems, these systems are typically limited to commercial applications or large multi-family dwellings. Furthermore, such systems may themselves cause unnecessary damage to a dwelling, particularly in the case of a false trigger. Water sprinkler systems present additional challenges in that the pipes used may be subject to freezing, may require the installation of additional pumps, and may be expensive when retrofitting an existing structure with such systems.

What is needed is a system that is capable of quickly detecting a fire that may also aid in preventing completion of the fire tetrahedron or reduce any one of the fire tetrahedrons elements thereby reducing or ending combustion.

SUMMARY OF THE INVENTION

A system and method of detection and suppression is proposed which aids in reducing the injury and loss of human life and property. In one embodiment of the invention, one or more elements of the fire tetrahedron, namely, heat, oxygen, and fuel rich smoke are reduced by evacuating these elements from a compartment to slow the growth of the fire in that compartment. Additionally, the natural depletion of oxygen in surrounding rooms of the structure, caused by the fire, is accelerated by the evacuation of oxygen by such an embodiment of the invention.

In one embodiment, a traditional HVAC system (either comprising a central air conditioning system, a central heating system, or a combination of the two) is modified to exhaust heat, oxygen, and fuel rich smoke from a room or other compartment. By removing these elements from the compartment, facets of the fire tetrahedron are diminished and combustion is hindered. In one embodiment, existing HVAC systems are used by modifying a central HVAC supply plenum to include a vent to the exterior of a structure and an exhaust fan. Further, a damper mechanism may be included to close the air flow to an air conditioning fan that is used during normal operation while another damper may be used to open a path to allow the exhaust air to escape. In this way, the exhaust fan reverses the direction of typical flow into a room or compartment and now exhausts these elements. According to one embodiment, additional compartment vent dampers may be utilized to close supply vents that would otherwise supply air to additional compartments during normal operation.

According to one embodiment of the invention, the modified HVAC system is combined with detection means. Although conventional detection means (such as an ionizing smoke detector, a photoelectric sensor, or a traditional temperature sensor) may be used, other detection means may be used that may more quickly and accurately detect a fire.

In one embodiment, detection may be enhanced by accelerating the air mass that interfaces with the detector. This may be achieved by creating airflow from within the room or compartment into a detection chamber where a sensor is located. Such airflow may be created through use of a fan of suitable horsepower, although airflow creation means other than a fan may be apparent to those of skill in the art.

DRAWINGS

DETAILED DESCRIPTION

Figure 1:
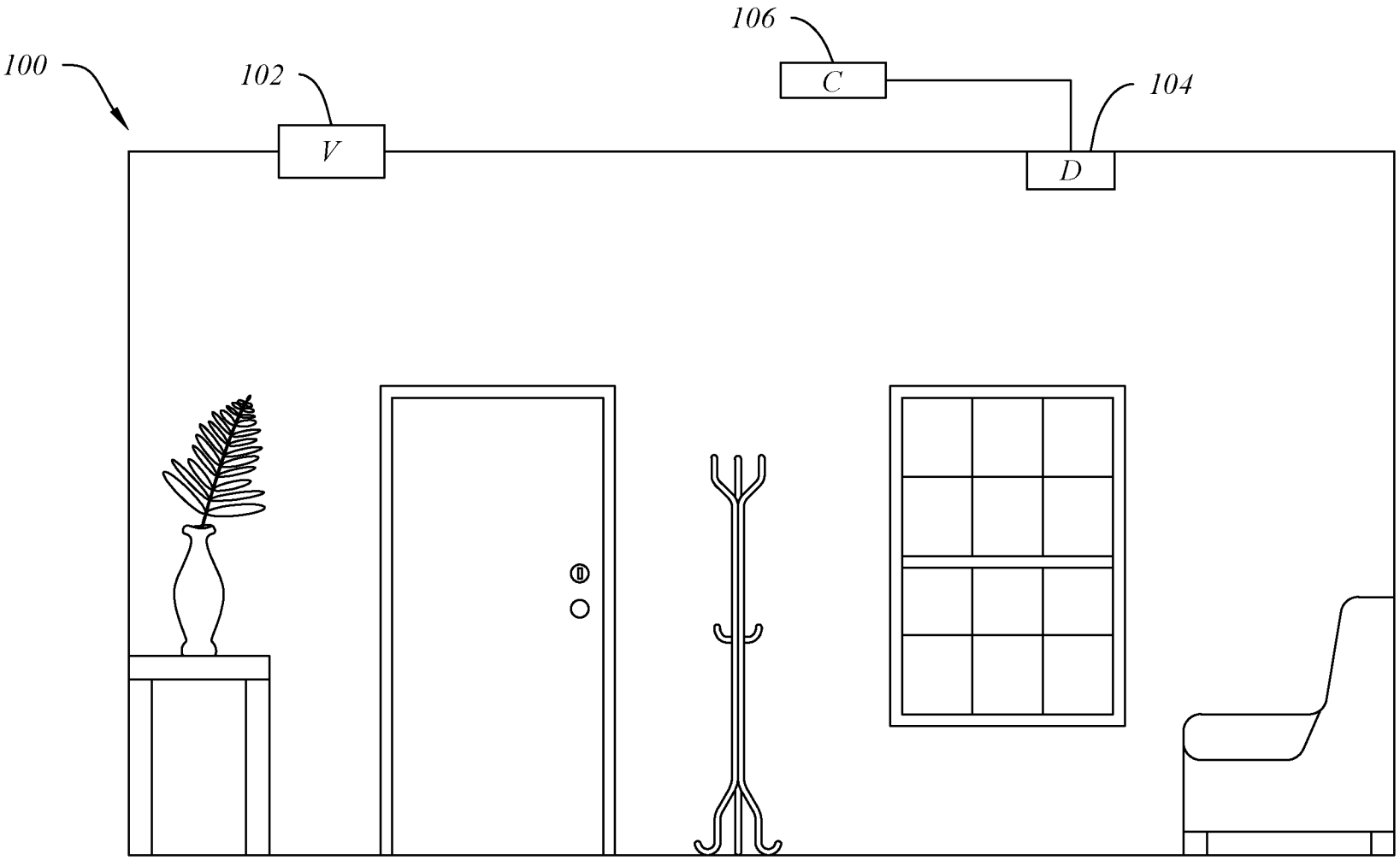
FIG. 1 shows various aspects of the evacuation system in accordance with one embodiment of the invention.

Turning now to FIG. 1, compartment 100 comprises vent 102 and detector 104. Vent 102 is principally designed to supply conditioned air in accordance with a traditional HVAC system. During normal operation, warm or cool air is supplied by vent 102 to heat or cool compartment 100.

Once a fire has begun in compartment 100, detector 104 may sense any number of environmental factors to determine the beginning of a fire event. Detector 104 may be a conventional fire detection device such as an ionization smoke detector that is able to ionize sampled air from a compartment and compare that air to a control sample; a difference in current carried by the air in the two samples may indicate the presence of smoke and activate an alarm. Detector 104 may also be a photoelectric smoke detector which measures light intensity transmitted from a known light source and alarms when the received light intensity is below an expected value. It is presumed that the received light intensity from the known light source decreases due to the presence of smoke or dust particles that are indicative of a fire. Other variations of smoke detectors may be used, including, for example, laser detectors, infrared detectors, radar detectors, thermal imaging detectors, video-based smoke and flame center detectors, optical flame detection, ultraviolet light radiation sensors, smoke gas sensors, linear extinction sensors, audio-detection sensors, optical smoke sensors, heat detection sensors, and flame detection sensors, thermostatic detection, thermostatic digital actuators, camera analytics, thermal imaging, motion detection, fast optical computation, optical flow sensing, situational awareness technology, video denoising, image stabilization, unsharp masking, super resolution or aspirating sensors as described below with respect to FIG. 5 or FIG. 6 may be used.

In the event of a fire, convection causes warmer air to rise toward the top of compartment 100. Once detector 104 has been triggered to indicate the potential presence of a fire or other relevant environmental event, detector 104 notifies controller 106 of an alarm state. Detector 104 may be connected to controller 106 by wire, or may utilize any means of wireless communication, including, for example, WiFi, Bluetooth, ZigBee, RF, or other means. Controller 106 will cause the typical airflow of vent 102 to be reversed, thereby evacuating air from compartment 100 and slowing the rate of fire growth. This operation is further described below.

Although hot air is exhausted through vent 102, additional fresh air is not supplied to the compartment through a return path vent. Additionally, through the operation of the vent, oxygen is exhausted from the room. In one embodiment of the invention, a return vent may not be used.

Figure 2:
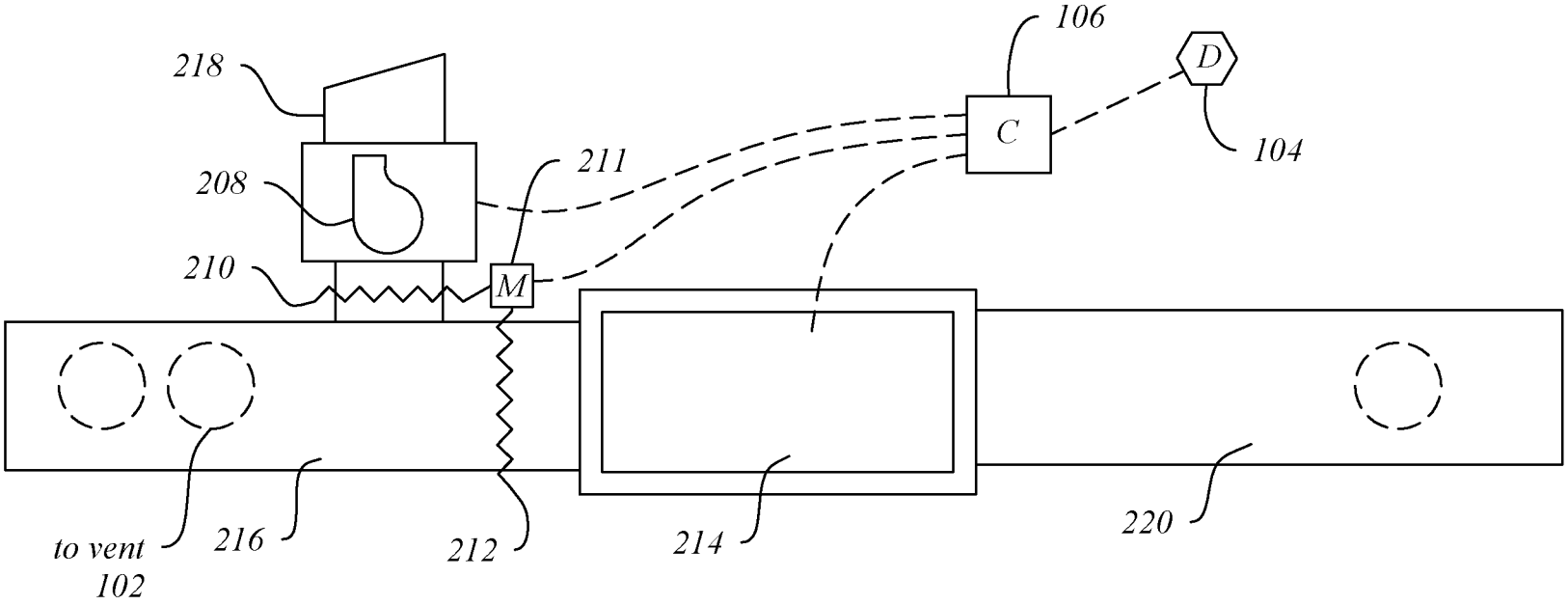
FIG. 2 shows various aspects of the evacuation system in accordance with another embodiment of the invention.

Turning now to FIG. 2, after receiving notification of an alarm state, controller 106 may simultaneously or sequentially carry out a number of functions, including, but not limited to (a) activating HVAC evacuation mechanism 208, (b) opening evacuation damper 210, (c) closing supply damper 212, (d) disabling HVAC supply fan 214, (e) alerting an emergency response organization, (f) sounding an alarm within compartment 100, (g) sounding an alarm on the premises of compartment 100, and (h) activating additional emergency response options.

In one embodiment, HVAC evacuation mechanism 208 is a smoke evacuation fan located downstream of evacuation damper 210. The smoke evacuation fan is sufficiently powered to evacuate heated air that has risen in compartment 100. Due to evacuating heated air, the temperature within compartment 100 will not rise as rapidly as in a traditional fire event; as a result decreasing the presence of a necessary element for fire growth and helping to contain a fire event. Because heated air will be moved through supply plenum 216, supply plenum is preferably rated to handle temperatures as high as 600 degrees Fahrenheit and rated to handle smoke.

In one embodiment, evacuation damper 210 which may be located upstream of the smoke evacuation fan is controlled by damper motor 211 that is activated by controller 106. Damper motor 211 may optionally be configured to also close supply damper 212. Alternatively, supply damper 212 may be powered by a separate motor. Alternatively, evacuation damper 210 and supply damper 212 may be combined as a single structural element. Controller 106 may be connected to damper motor 211 by wire or wirelessly. HVAC evacuation mechanism 208 exhausts heat, oxygen, and/or smoke through smoke exhaust 218.

During normal operation, the HVAC system operates with air supplied to various compartments through supply plenum 216. Supply is provided through supply fan 214 which is fed through return plenum 220. Further, during normal operation, HVAC evacuation mechanism 208 is de-energized, evacuation damper 210 is closed, and supply damper 212 is open.

In one embodiment, controller 106 alerts local emergency authorities automatically by placing a call over a land-based or cellular network. In another embodiment, controller 106 may contact a centralized monitoring center with information about the alarm event. The centralized monitoring center may then contact emergency authorities with information about the alarm event.

In one embodiment, once an alarm state has been triggered, detector 104 emits an alarm sound at the compartment where it is located. Alternatively, detector 104 may communicate with other detectors on the premises and cause other detectors to additionally emit an alarm sound. In this manner, individuals located on the premises but outside of compartment 100 may be notified of the event in compartment 100. In another embodiment, controller 106, after receiving an alert from detector 104, may be programmed to cause other detectors to emit an alarm sound. Additionally, or in the alternative, controller 106 may be configured to notify an account holder through other electronic means that a detection event has occurred. Such notification may be through electronic mail, for example, or may be made through a mobile application. Additional notification means, such as through a paging device, may also be used. Controller 106 may also be configured to transmit a notification to an emergency service. Such emergency service could be an alarm monitoring company. Controller 106 may also be configured to transmit a notification to an emergency authority or emergency dispatcher.

Detector 104 may be configured to transmit information to controller 106 regarding additional details about the detected event. For example, if detector 104 detects an alarm condition that is transient, detector 104 may transmit information to controller 106 that the alarm condition is no longer present. Controller 106 may be programmed to relay that information to the account holder so that the account holder may know, for example, that the controller has interpreted the event to be a false alarm. In one embodiment, controller 106 may include software algorithms designed to detect alarm conditions. Such algorithms may be configured or reconfigured with intelligence that analyzes certain permitted heat sources (e.g., a candle or a cigarette) and distinguishes such sources from unpermitted heat sources (e.g., a candle that has grown beyond an expected size or intensity).

Figure 3:
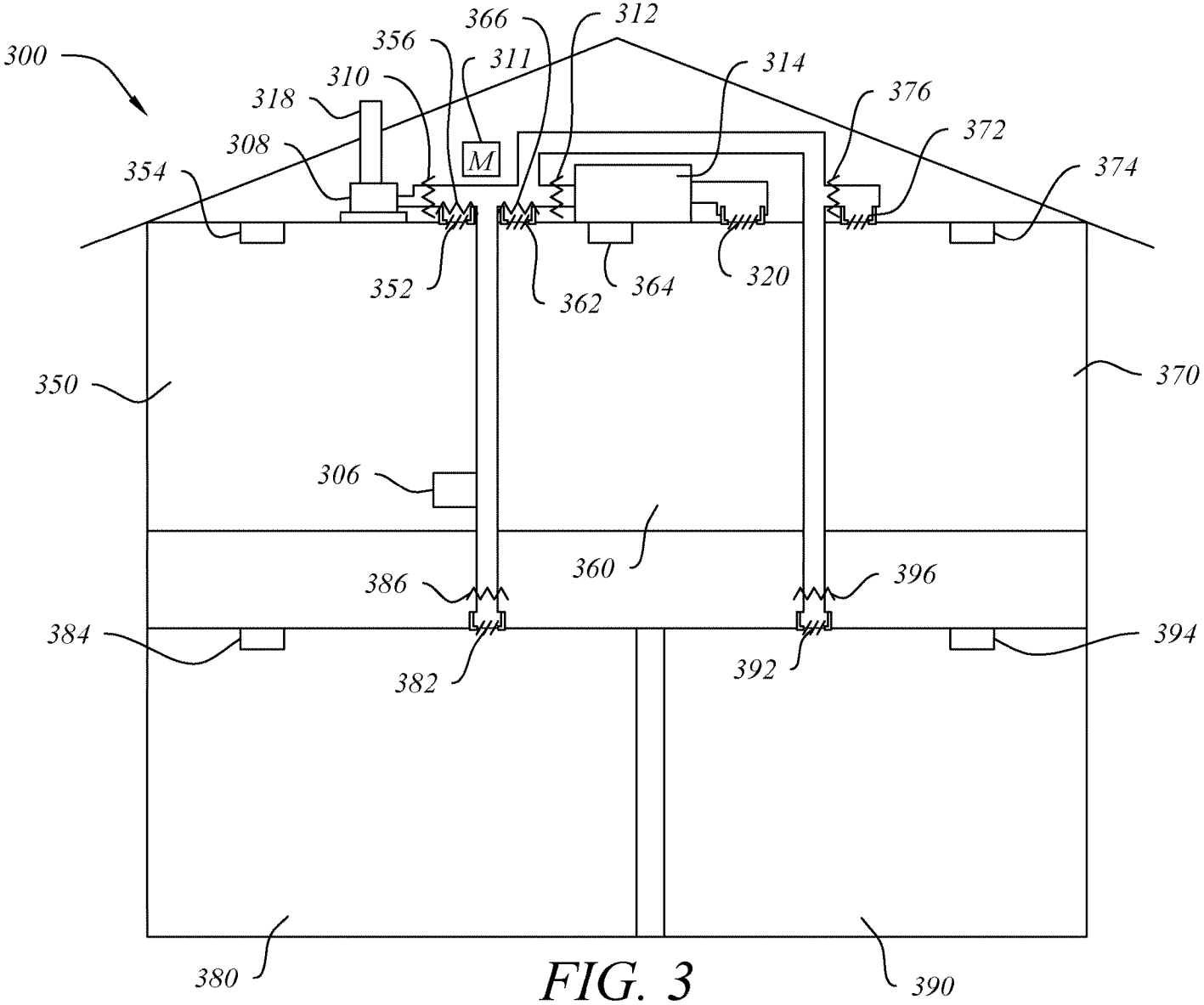
FIG. 3 shows various aspects of the evacuation system disposed inside an exemplary residential dwelling in accordance with another embodiment of the invention.

Turning now to FIG. 3, an example of a household with an embodiment of the detection and suppression system is depicted. Compartments 350, 360, 370, 380, and 390 are located throughout household 300. Detectors 354, 364, 374, 384, and 394 are disposed in respective compartments. Additionally, vents 352, 362, 372, 382, and 392 are disposed in their respective compartments. As depicted, detectors are connected wirelessly to controller 306 which is depicted in compartment 350 for easy user interaction. Controller 306 is also connected (here, wirelessly) to smoke evacuation fan 308, evacuation damper 310, damper motor 311, supply damper 312, and air handler 314. Air handler 314 is connected to vents and also fed by return plenum 320. In one embodiment, additional vent dampers 356, 366, 376, 386 and 396 may be installed. The additional vent dampers may be selectively closed during an air evacuation, e.g., if a fire is detected in compartment 350, controller 306 may communicate to vent dampers 366, 376, 386, and 396 to close while leaving vent damper 356 open.

Smoke evacuation fan 308 is connected to smoke exhaust 318 to exhaust heat, oxygen, and/or smoke when evacuation damper 310 is open and smoke evacuation fan 308 is energized. In the scenario depicted, many parts of the system may already be available inside existing structures. For example, a residential home may already be equipped with duct work, supply vents, a return vent, and an air conditioner. Thus, an existing air conditioning system may be retrofitted by adding smoke exhaust 318, smoke exhaust fan 308, evacuation damper 310, damper motor 311, supply damper 312, controller 306, and any necessary detectors.

Figure 4:
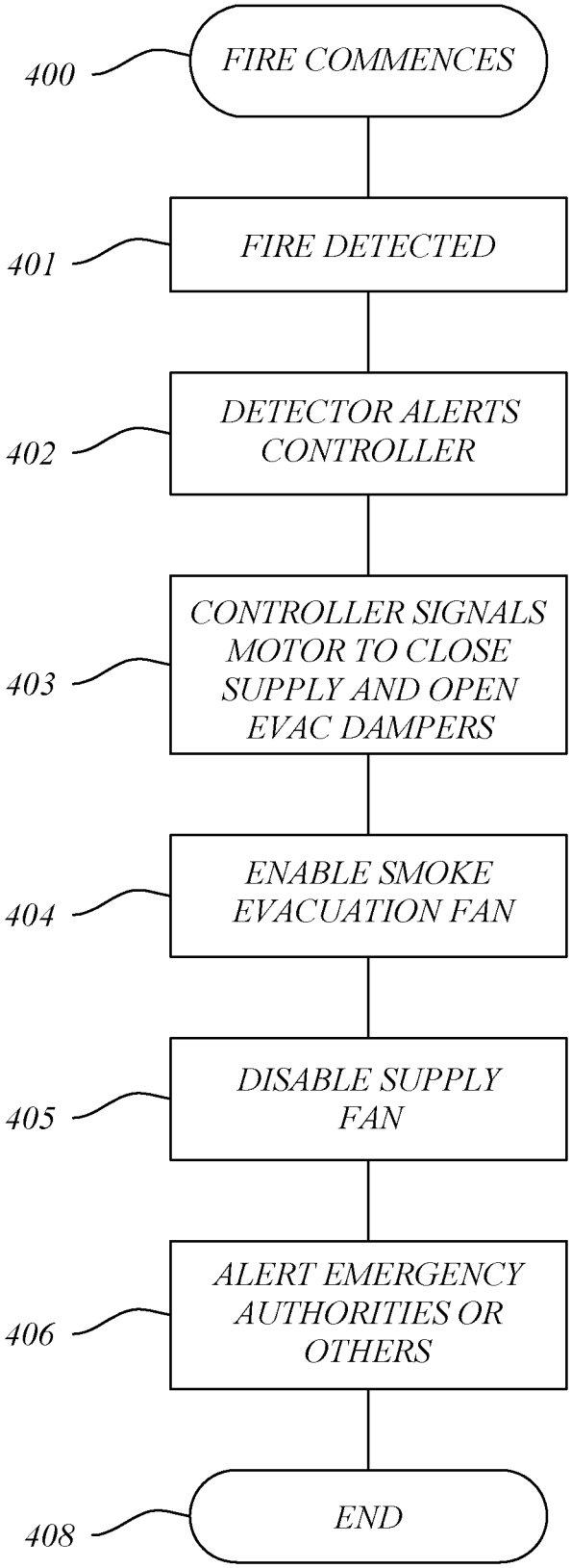
FIG. 4 is a flow diagram illustrating one embodiment of a process for detecting a fire event and evacuating air from a compartment.

FIG. 4 depicts an exemplary method of the detection and suppression system. After a fire has commenced (step 400), at step 401 smoke detection mechanism detects a fire. At step 402, smoke detection mechanism alerts controller 106. At step 403, controller 106 communicates with damper motor 211 to open evacuation damper 210 and close supply damper 212. At step 404, controller 106 communicates with smoke evacuation fan to enable smoke evacuation fan. At step 405, controller 106 communicates with supply fan 214 to disable supply fan 214. At step 406, controller alerts local emergency authorities and users as needed. One of skill in the art may recognize that a different order of steps is possible in certain circumstances, for example, the supply fan may be disabled before the motor signals that the dampers should be actuated. Alternative, certain steps may occur simultaneously.

Figure 5:
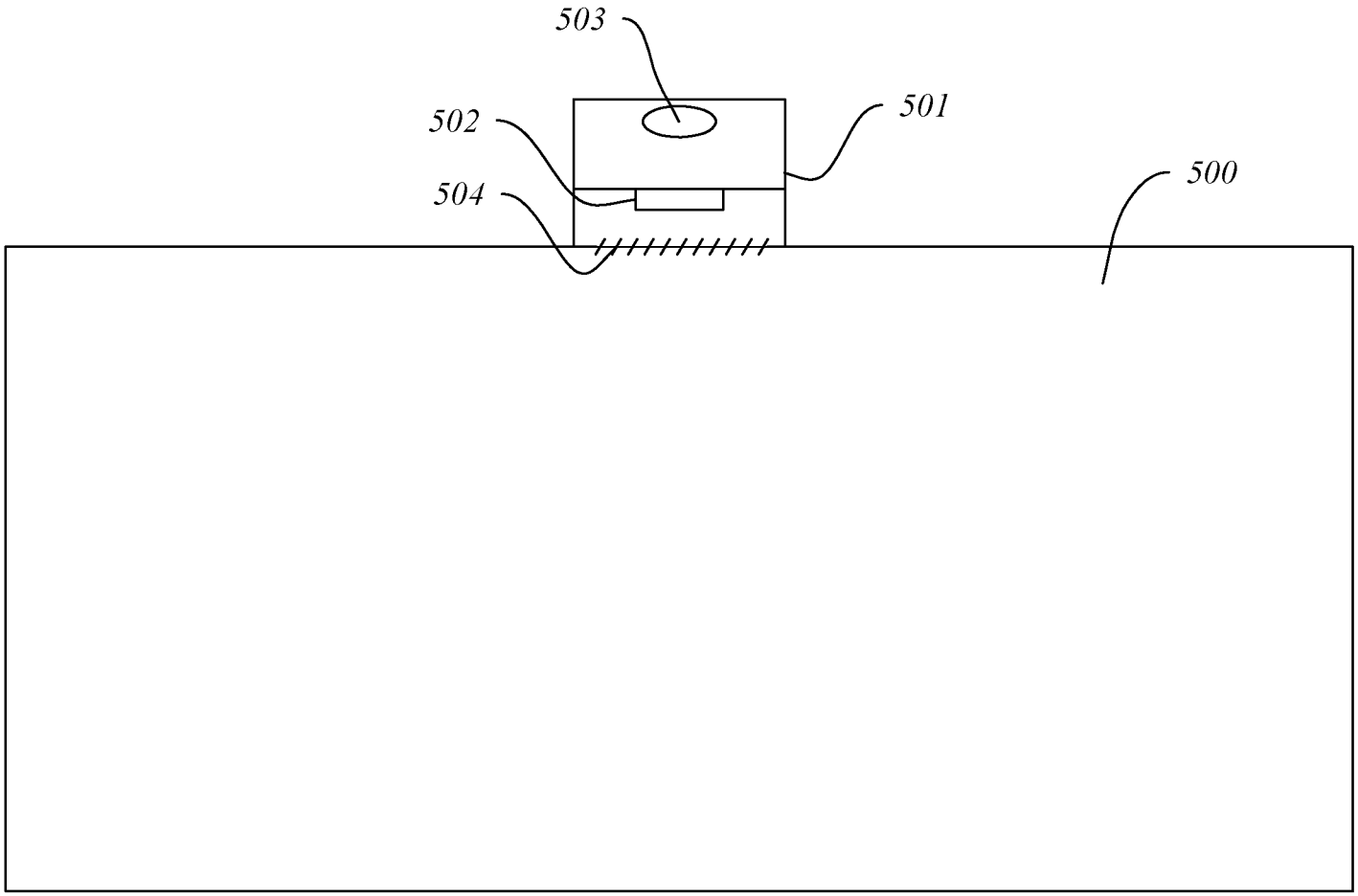
FIG. 5 shows various aspects of an aspirating detection system in accordance with another embodiment of the invention.
Figure 6:
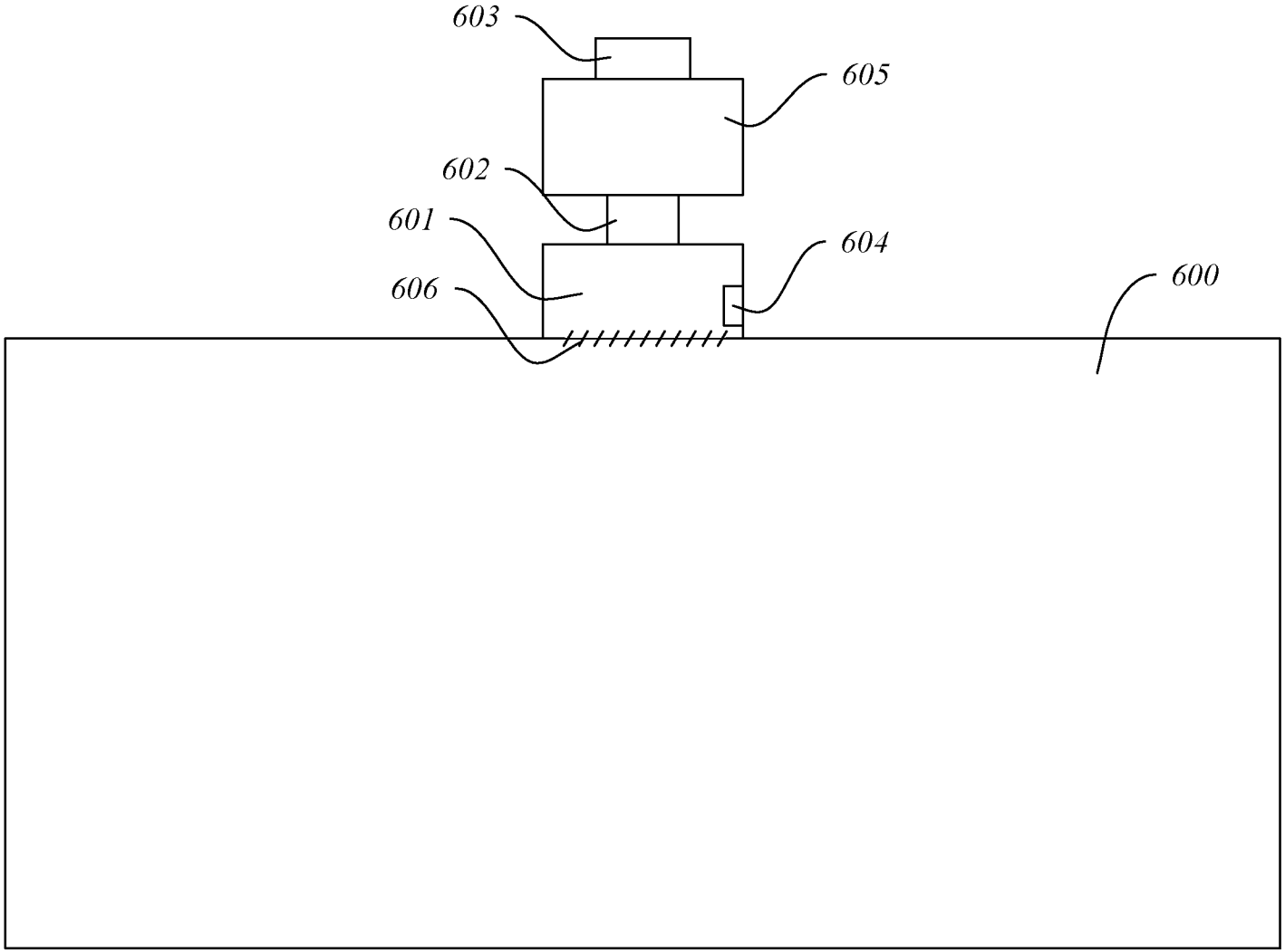
FIG. 6 shows various aspects of an aspirating detection system in accordance with another embodiment of the invention.

FIG. 5 depicts an alternative fire detection mechanism. While the evacuation and detection system described above may use known fire and smoke detection means, operation may be improved by utilizing the below described alternative detection means. In one embodiment, a conventional photoelectric detector 502 is disposed within aspiration chamber 501 that is located at or near the top of compartment 500. Disposed at the top of aspiration chamber 501 is fan 503 which creates a draw of air from compartment 500 by way of vent 504. In this way, smoke and particulate matter can be drawn from compartment 500 more rapidly than would happen through natural convection caused by a fire.

In one embodiment, the detector is situated in a removal chamber. The removal chamber may be a sufficiently sized chamber (e.g., 12"×12"×12") with a 2" diameter duct and an intake fan disposed at or near the top of the chamber. In such an embodiment, the removal chamber may act as a reservoir that may create a static air environment to the extent that detection requires such a condition.

Detector 502 need not be a photoelectric detector. In another embodiment, detector 502 may be an ionization detector. By placing the detector inside a chamber that is drawing air from the compartment below, either type of detector may benefit from faster detection than would occur by way of convection alone. Alternatively, one of skill in the art may appreciate that other detectors may be used inside of chamber 501.

Air from chamber 501 may be exhausted into void spaces within a structure, or may be exhausted external to a structure using appropriate exhaust mechanisms. Fan 503 may be connected to controller 106 and may be turned off subsequent to the detection of a fire event.

In an alternative embodiment, a conventional photoelectric detector 604 is disposed within detection chamber 601 that is located at or near the top of compartment 600. Disposed at or near the top of detection chamber 601 is round duct 602 connecting detection chamber to fan chamber 605 and fan 603. Operation of fan 603 creates a draw of air from compartment 600, by way of vent 606. In this way, smoke and particulate matter can be drawn from the compartment more rapidly than would happen through natural convection caused by a fire. In this embodiment, the detection chamber may act as a reservoir that may create a static air environment to the extent that detection requires such a condition. In a preferred embodiment fan chamber 605 is also tapered to promote a favorable airflow. In an alternative embodiment, detection chamber 601 may be sufficiently tall to create a static air environment without the presence of fan chamber 605, e.g., fan 603 may be directly coupled with duct 602.

Detector 604 need not be a photoelectric detector. In another embodiment, detector 604 may be an ionization detector. By placing the detector inside a chamber that is drawing air from the compartment below, either type of detector may benefit from faster detection than would occur by way of convection alone. Alternatively, one of skill in the art may appreciate that other detectors may be used inside of chamber 601.

Air from chamber 601 may be exhausted into void spaces within a structure, or may be exhausted external to a structure using appropriate exhaust mechanisms. Fan 603 may be connected to controller 106 and may be turned off subsequent to the detection of a fire event.

Throughout a premises, any combination of conventional and aspirating sensors may be deployed. Alternatively, smart detection sensors which utilize thermal imaging may be disposed throughout the premises and may provide thermal imaging data to controller 106. Controller 106 may compile thermal imaging data from compartments around a premises to provide advanced fire detection means using detection algorithms that are capable of distinguishing between allowed thermal anomalies (e.g., candles) and unplanned thermal anomalies (e.g., grease fires).

The foregoing detailed description has been given for clearness of understanding only, and no unnecessary limitation should be understood therefrom. While the present invention has been described with reference to preferred embodiments and several alternative embodiments, which embodiments have been set forth in considerable detail for the purposes of making a complete disclosure of the invention, such embodiments are merely exemplary and are not intended to be limiting or represent an exhaustive enumeration of all aspects of the invention. The scope of the invention therefore shall be defined solely by the claims. Further, it will be apparent to those of skill in the art that numerous changes may be made in such details without departing from the spirit and the principles of the invention. It should be appreciated that the present invention is capable of being embodied in other forms without departing from its essential characteristics.

What is claimed is:

1. A system for suppressing fire growth within a compartment comprising:

a processor;

a detector in communication with said processor;

an exhaust fan in communication with said processor, the exhaust fan coupled to a supply plenum that extends from an air handling unit to one or more supply vents that are located in one or more compartments of a structure;

a supply damper in communication with said processor, wherein the supply damper is located in the supply plenum between the exhaust fan and the air handling unit;

an evacuation damper in communication with said processor, wherein the evacuation damper is located in the supply plenum between the exhaust fan and the one or more supply vents;

wherein, upon receiving an alert signal, said processor is configured to:

cause a close signal to be transmitted to said supply damper thereby blocking airflow through the supply plenum between the exhaust fan and the air handling unit;

cause an open signal to be transmitted to said evacuation damper thereby allowing airflow through the supply plenum between the exhaust fan and the one or more supply vents; and cause a start signal to be transmitted to said exhaust fan.

2. The system of claim 1, wherein said supply damper is disposed downstream of the air handling unit in a central air conditioning system and said evacuation damper is disposed upstream of said exhaust fan.

3. The system of claim 2 wherein said detector further comprises:

a detection chamber, and an aspiration fan, wherein said aspiration fan operates to draw air from the compartment to said detection chamber and wherein said detector is configured to detect conditions in air supplied to said detection chamber.

4. The system of claim 2, further comprising:

a compartment vent damper in communication with said processor;

wherein said processor is further configured to cause a second close signal to be transmitted to said compartment vent damper.

5. The system of claim 2 wherein said detector comprises a thermostatic detector.

6. The system of claim 2 wherein said processor is connected wirelessly to said detector.

7. The system of claim 2 wherein said supply damper communicates said open signal to said evacuation damper.

8. The system of claim 2 wherein said processor causes an event notification to be transmitted.

9. The system of claim 8 wherein said event notification is transmitted to an emergency authority.

* * * * *